US012790081B2

(12) United States Patent
Fresnel

(10) Patent No.: US 12,790,081 B2
(45) Date of Patent: Nov. 10, 2026

(54) CAPSULE AND CONTAINER ENCLOSED BY SUCH A CAPSULE

(71) Applicant: SLEEVER INTERNATIONAL COMPANY, Morangis (FR)

(72) Inventor: Eric Fresnel, Paris (FR)

(73) Assignee: SLEEVER INTERNATIONAL COMPANY, Morangis (FR)

( * ) Notice: Subject to any disclaimer, the term of this patent is extended or adjusted under 35 U.S.C. 154(b) by 0 days.

(21) Appl. No.: 19/441,147

(22) Filed: Jan. 6, 2026

(65) Prior Publication Data

US 2026/0200642 A1 Jul. 16, 2026

(30) Foreign Application Priority Data

Jan. 10, 2025 (FR) ..... 2500277

(51) Int. Cl.
*B65D 41/54* (2006.01)
*B65D 41/24* (2006.01)

(52) U.S. Cl.
CPC ..... *B65D 41/54* (2013.01); *B65D 41/24* (2013.01)

(58) Field of Classification Search
CPC ..... B65D 41/54
USPC ..... 215/246; 220/257.2, 257.1
See application file for complete search history.

(56) References Cited

U.S. PATENT DOCUMENTS

2018/0118432 A1 5/2018 Fresnel
2021/0276763 A1 9/2021 Oh

FOREIGN PATENT DOCUMENTS

AT 296807 B * 2/1972 ..... B65D 41/54
GB 1467662 A * 3/1977 ..... B65D 41/24

* cited by examiner

*Primary Examiner* — Mollie Impink
(74) *Attorney, Agent, or Firm* — MUNCY, GEISSLER, OLDS & LOWE, P.C.

(57) ABSTRACT

A capsule includes a body, consisting of a head and a skirt extending from the head along an axial direction, the skirt including at least three sections extending successively along the axial direction, the first section and the second section jointly forming a first shoulder of the skirt, the second section and the third section jointly forming a second shoulder of the skirt, the skirt being shaped such that its diameter increases in its second section, relative to the first section, and then narrows in its third section, relative to the second section. The container is enclosed by such a capsule.

10 Claims, 2 Drawing Sheets

CAPSULE AND CONTAINER ENCLOSED BY SUCH A CAPSULE

The invention relates to a capsule made of heat-shrinkable plastic.

The invention also relates to a container covered by such a capsule.

BACKGROUND OF THE INVENTION

In the field of wine and spirits bottles, it is known to overmould the stopper by means of metal capsule which are pressed onto bottles or crimped onto bottles.

For a variety of reasons, such as costs, metal capsules may be replaced by plastic capsules, for example, made of shrinkable plastic material.

Usually, such capsules are stacked on top of each other to form a column, said column being placed in a storage magazine of a packaging machine. The storage magazine also comprises gripping means allowing a single capsule to be detached from the column in order to move it to the associated bottle.

The problem is that such heat-shrinkable capsules are relatively thick.

This is detrimental in view of the current difficulties in procuring raw materials and/or the environmental constraints making it necessary to reduce the use of raw materials.

AIM OF THE INVENTION

The aim of the invention is to propose a new capsule made of heat-shrinkable plastic material, in particular, for containers, that is more optimised.

The invention also relates to a container covered by such a capsule.

SUMMARY OF THE INVENTION

In order to achieve this aim at least in part, a capsule is proposed comprising a body made of heat-shrinkable plastic material, the body comprising:

a head;

a skirt extending from the head along an axial direction, the skirt comprising at least three sections extending successively along the axial direction, the first section and the second section jointly forming a first shoulder of the skirt, the second section and the third section jointly forming a second shoulder of the skirt, the skirt being shaped such that its diameter increases in its second section, relative to the first section, and then narrows in its third section, relative to the second section.

Thus, the two shoulders make it possible to stiffen the capsule. The thickness of the capsule may thus be reduced compared with the capsules of the prior art.

In particular, because of its shape, even with a reduced thickness compared with the capsules of the prior art, the invention may still be fitted into a column formed of multiple capsules and be easily extracted from it.

The invention is thus more environmentally-friendly.

In addition, the shoulder furthest from the head makes it possible to prevent said capsule from being pushed too deeply into another capsule. This makes it even easier to remove the invention from a column of capsules.

In the present application, a "material" designates all of the materials forming an element. The material may thus be formed from a single material or from multiple materials, each material itself being derived from a composition that may comprise a single component or a plurality of components. Thus, when it is indicated that the body is made of a "heat-shrinkable plastic material", the body may be formed of a single layer or of multiple layers, each body then being made of a different material from that of the other layers. Regardless of whether the body comprises a single layer or multiple layers, at least one layer may be formed from a composition comprising a single component or multiple components. For example, each layer may be formed from a composition comprising a single type of polymer or comprising multiple types of polymers.

In the present application, the term "diameter" must be understood in the mathematical sense of the term: it is the upper limit of the set of distances of any two points of an object in question. The diameter is therefore not necessarily associated with a circular-shaped object.

Optionally, the first section is contiguous with the head, the second section being arranged under the first section and the third section being arranged under the second section.

Optionally, at least one of the sections is cylindrically-shaped.

Optionally, at least one of the present shoulders has a flat portion.

Optionally, the flat portion extends in a plane that is normal to the axial direction.

Optionally, the opening is centred on the head.

Optionally, the body is made of or based on PET.

Optionally, an internal surface of the body and an external surface of the body have different slip coefficients.

Optionally, at least one of the second or third sections is externally in the shape of a truncated cone.

The invention relates to a container covered by a capsule, as mentioned above.

Other features and advantages of the invention will appear upon reading the description below, of particular, non-limiting embodiments of the invention.

BRIEF DESCRIPTION OF THE DRAWINGS

The invention is best understood in the light of the following description, in reference to the accompanying figures, among which.

DETAILED DESCRIPTION OF THE INVENTION

Figure 1:
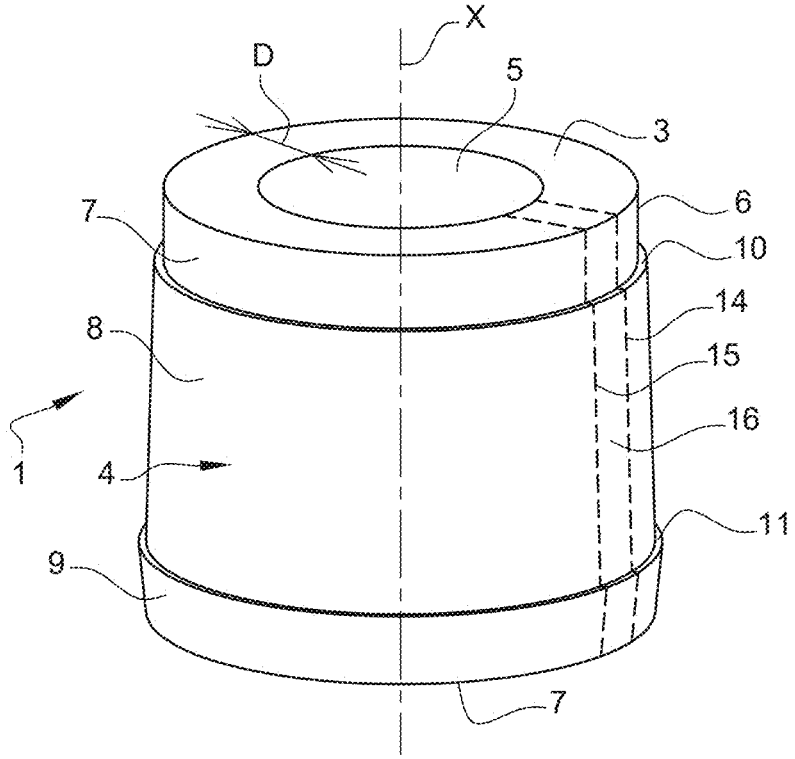
FIG. 1 is a diagrammatic perspective view of a capsule according to a first embodiment of the invention.
Figure 2:
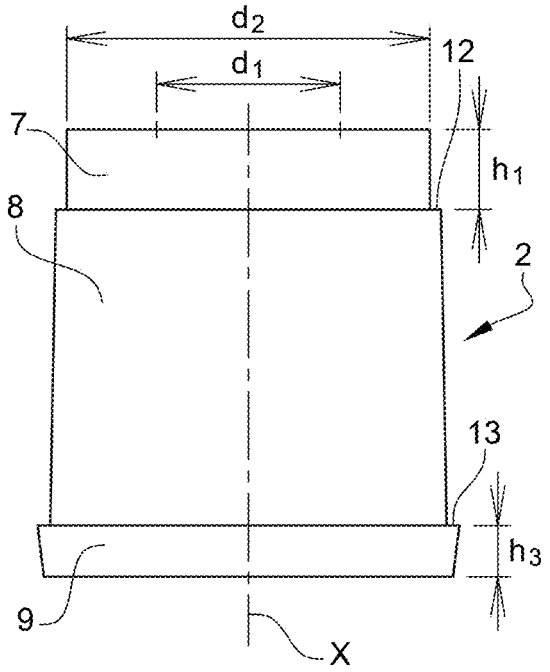
FIG. 2 is a diagrammatic side view of the capsule shown in FIG. 1.
Figure 3:
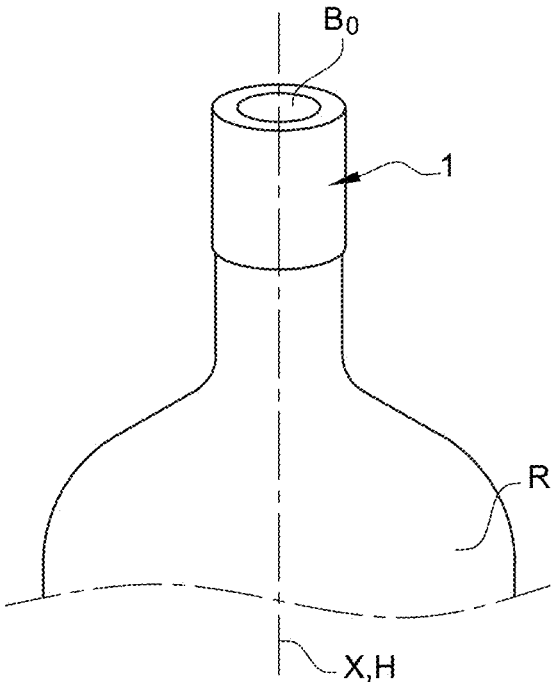
FIG. 3 is a perspective view of a part of a container sealed by the capsule shown in FIG. 1.

With reference to Figures to 3, the capsule 1 according to the first embodiment of the invention comprises a body 2. In the present example, the capsule 1 forms one single piece. In the present case, the capsule 1 is formed solely by the body 2.

In this case, the body 2 is formed by a film folded on itself and sealed in at least one area. The body 2 thus forms a sleeve that is closed laterally but open at least at the lower part.

The body 2 is made of heat-shrinkable plastic material. The body 2, for example, is produced by cutting a piece of film made of said heat-shrinkable plastic material, that has been stretched such that it has at least one preferred direction of shrinkage. In this case, the film is stretched along an axial direction X along which the capsule 2 extends longitudinally or along a direction that is orthogonal to the axial direction X.

The body 2 is, for example, based on, or made of, polyester such as polyethylene terephthalate (better known by the acronym PET) or polylactic acid (better known by the acronym PLA) or even polyvinyl chloride (PVC).

For example, the body 2 forms one single layer.

Regardless of the material of the body 2, it may be formed from a composition comprising at least one portion of recycled material. Per 100 parts of composition, the composition comprises between 0 and 100 parts by weight of recycled material and, for example, between 0 and 60 parts by weight of recycled material and, for example, between 0 and 50 parts by weight of recycled material and, for example, between 0 and 30 parts by weight of recycled material and, for example, between 0 and 20 parts by weight of recycled material. Said recycled material may be either pre-consumer or post-consumer material.

For example, the body 2 may be made of PET R30 (30 parts by weight of recycled material) or PET R50 (50 parts by weight of recycled material).

The body 2 has, for example, a thickness of less than 100 micrometres, and, for example, a thickness of less than 90 micrometres, and, for example, of 41 less than 75 micrometres.

The body 2 is also shaped so as to have a head 3 as well as a skirt 4 extending from the head 3 along an axial direction (that coincides with the axial direction X of the capsule). The skirt 4 thus forms an extension of the head 3.

The skirt 4 and the head 3 preferably form one single piece. Since the skirt 4 and the head 3 form one single piece, no step is required to secure one to the other.

In this case, the head 3 is flat. The head 3 thus extends in a plane that is normal to the axial direction X. The head 3 forms a disc perforated by an orifice 5 passing through it. The orifice 5 extends along the axial direction X. The orifice 5 is preferably centred in the disc. The orifice 5 thus extends coaxially along the axial direction X.

As a result, the head 3 is crown-shaped. The head 3 is thus shaped such that the difference D between its internal radius and its external radius is between 1 mm and 20 mm and is, for example, between 3 mm and 18 mm and is, for example, between 3 mm and 10 mm.

For example, the diameter $d_1$ of the orifice 5 (i.e., double the internal radius of the head 4) is between 17 mm and 25 mm and is, for example, between 20 mm and 24 mm and is, for example, 22 mm. For example, the diameter $d_1$ of the orifice 5 is between 10% and 70% of the external diameter $d_2$ of the head 4 (i.e., double the internal radius of the head 4) and, for example, between 15% and 60% of the external diameter $d_2$ of the head 4.

The skirt 4 extends in line with the head 3 along the axial direction X. The skirt 4 extends preferably coaxially to the axial direction X.

The skirt 4 comprises at least three sections extending successively along the axial direction X. Since the various sections form one single piece, no step is required to secure one to the other.

The first section 7 extends in line with the head 3, the second section 8 extends in line with the first section 7 and the third section 9 extends in line with the second section 8. The second section 8 thus lies between the first section 7 and the third section 9. In this case, each section extends coaxially along the axial direction X.

The First Section 7

Optionally, the first section 7 has a cross-section that is constant along its entire length (considered along the axial direction X).

Preferably, the first section has a circular cross-section. For example, the first section is shaped as a hollow cylinder.

For example, the first section 7 has a height $h_1$ of between 3 mm and 9 mm and has, for example, a height $h_1$ of between 5 mm and 7 mm and has, for example, a height $h_1$ of between 5.9 mm and 6.1 mm.

The First Section 8

Optionally, the second section 8 has a cross-section that is not constant along its entire height (considered along the axial direction X).

The second section 8 thus has a cross-section that increases along its entire length. Preferably, this section increases homogeneously. Thus, the external surface of the second section 8 is smooth. For example, the second section 8 has an external surface that has a slope of between 0.1° and 2° and, for example, between 0.5° and 1.5°. For example, said slope is 1° (optionally plus or minus 0.1°).

This slope may also be characterised by an angle (of between 0.1° and 2° and, for example, of between 0.5° and 1.5° and is, for example, 1° [optionally plus or minus 0.1°]) formed between the axial direction X and a straight line starting from an imaginary vertex of the second section 8 and a point of a base of the second section 8.

Preferably, the second section 8 is in the shape of a body of revolution, and for example, is in the shape of a hollow truncated cone. Thus, relative to the axial direction X, the apothem of the second section 8 has an angle of between 0.1° and 2° and, for example, of between 0.5° and 1.5°, and that is, for example, 1° (optionally plus or minus 0.1°).

Preferably, the second section 8 flares in the opposite direction to the first section 7.

The Third Section 9

Optionally, the third section 9 has a cross-section that is not constant along its entire length (considered along the axial direction X).

The third section 9 thus has a cross-section that decreases along its entire height. Preferably, this section decreases homogeneously. Thus, the external surface of the third section 9 is smooth. For example, the third section 9 has an external surface that has a slope of between 1° and 3° and, for example, between 1.5° For example, said slope is 2° (optionally plus or minus 0.1°).

This slope may also be characterised by an angle (of between 1° and 3° and, for example, of between 1.5° and 2.5° and is, for example, 2° [optionally plus or minus 0.1 degree]) formed between the axial direction X and a straight line starting from an imaginary vertex of the third section 9 and a point of a base of the third section 9.

Preferably, the third section 9 is in the shape of a body of revolution, and for example, is in the shape of a hollow truncated cone. Thus, relative to the axial direction X, the apothem of the third section 9 has an angle of between 1° and 3° and, for example, of between 1.5° and 2.5°, and that is, for example, 2° (optionally plus or minus 0.1°).

Preferably, the third section 9 tapers in the opposite direction to the second section 8.

The first section 7 and the second section 8 jointly form a first shoulder 10 of the skirt 4.

In this case, the first shoulder 10 forms a ring 12 between the first section 7 and the second section 8. The ring 12 is flat. The ring 12 thus extends in a plane having the axial direction X as its normal.

Preferably, the ring 12 extends orthogonally to the first section 7.

On the other hand, due to the flaring of the second section 8, the second section 8 extends in an inclined manner relative to the ring 12. The first shoulder 10 is thus partially at right angles.

Alternatively, a junction portion of the second section 8 with the first section 7 may be shaped so as to extend orthogonally to the ring 12 before the remainder of the second section 8 flares as indicated above. The first shoulder 10 would then be entirely at right angles.

The first shoulder 10 may form sharp and/or a rounded edges with the facing walls of the first section 7 and/or of the second section 8.

Furthermore, the second section 8 and the third section 9 jointly form a second shoulder 11 of the skirt 4.

In this case, the second shoulder 11 forms a ring 13 between the third section 9 and the second section 8. The ring 13 is flat. The ring 13 thus extends in a plane having the direction X as its normal.

On the other hand, due to the flaring of the second section 8 and the third section 9, said sections extend in an inclined manner relative to the ring 12.

Alternatively, a junction portion of the second section 8 with the third portion 9 and a junction portion of the third portion 9 with the second portion 8 may be shaped so as to extend orthogonally to the ring 12 before the remainder of the second section 8 and the third section 9 incline as indicated above. The second shoulder 11 would then be entirely at right angles.

The second shoulder 13 may form sharp and/or rounded edges with the facing walls of the third section 9 and/or of the second section 8.

As a result, the diameter of the skirt 4 is modified along its axial direction X due to the presence of the various sections.

In the present case, the diameter of the skirt 4 increases along its axial direction X in the direction opposite to the head 3 between the first section 7 and the second section 8, and then the diameter of the skirt 4 decreases along its axial direction X in the direction opposite to the head 3 between the second section 8 and the ninth section 9.

The second section 8 therefore has a larger average diameter than the first section 7. Optionally, the third section 9 also has a greater average diameter than the first section 7. Optionally, the average diameter of the third section 9 may be equal to, less than, or greater than the average diameter of the second section 8.

The first section 7 may, for example, have an average diameter of between 38 mm and 42 mm, and, for example, of between 39.2 mm and 40.2 mm The third section 9 has an average diameter of between 40 mm and 44 mm and, for example, of between 42.1 mm and 43.1 mm.

The capsule 1 is thus shaped such that it firstly flares and then tapers along its axial direction X in the direction of its lower end.

In the present example, the sections 7, 8, and 9 are not all of the same height. For example, all sections 7, 8, 9 are of different heights from those of the other sections 7, 8, 9.

Optionally, the height of the first section 7 is less than the height of the second section 8. Optionally, the height of the first section 7 is less than the height of the third section 9. For example, the first section 7 has a height $h_1$ of between 3 mm and 9 mm and has, for example, a height $h_1$ of between 5 mm and 7 mm and has, for example, a height $h_1$ of between 5.9 mm and 6.1 mm. For example, the height $h_1$ of the first section 7 is between 10% and 16% of that of the second section 8.

Optionally, the height of the third section 9 is less than the height of the second section 8. Optionally, the height of the third section 7 is greater than the height of the first section 7. For example, the third section has a height $h_3$ of between 4 mm and 11 mm and has, for example, a height $h_3$ of between 5 mm and 9 mm and has, for example, a height $h_3$ of between 6 mm and 8 mm. For example, the height $h_3$ of the third section 9 is between 17% and 21% of that of the second section 8.

As already indicated, the capsule 1 thus described forms one single piece.

Preferably, said capsule 1 comprises at least one pre-weakened area 14 provided in the body 2. This enables the capsule 1 to be torn open at this pre-weakened area 14.

The pre-weakened area 14 is, for example, formed by pre-cuts and/or micro-perforations. For example, the pre-cuts/micro-perforations may be made at regular intervals along the entire pre-weakened area 14.

Preferably, the pre-weakened area 14 forms a line.

For example, the pre-weakened area 14 extends along the entire height of the capsule 1.

Preferably, the pre-weakened area 14 comprises a first portion that extends along the skirt 4 and a second portion that extends along the head 3 along a radial direction of said head 3.

Preferably, the capsule 1 comprises at least one second pre-weakened area 15. Preferably, said second pre-weakened area 15 is arranged in the vicinity of the first pre-weakened area 14. In the present example, the second pre-weakened area 15 is identical to the first pre-weakened area 14. the two areas 14, 15 are therefore shaped in the form of two lines extending parallel to each other. As a result, the two areas 14, 15 delimit between them a strip 16 of the body 2. Said strip 16 is the one on which a user may pull to partition the capsule 1.

The capsule 1 thus described may therefore be arranged around a container R in order to at least enclose a section of said container R at 360°. For example, the capsule 1 encloses the container R so as to extend from an area of the neck of the container R to the stopper Bo of the container R. The skirt 4 then encloses the corresponding section of the neck at 360° and the head 3 partially covers an upper face of the stopper Bo.

In this position, the axial direction X extends along the axial direction H of the container R (that is vertical when the container R rests on a horizontal base).

The capsule 1 is then secured to the container 3 by means of heat shrinkage.

Advantageously, the first shoulder 10 makes it possible to position the capsule 1 in a more centred manner on the container R. The heat shrinkage of the capsule 1 on the container R is thus more homogeneous. The heat shrinkage is thus of a better quality.

Thus, the capsule 1 protects the container R from any fraudulent opening. In this case, the capsule 1 is therefore a safety capsule.

Moreover, the capsule 1 makes it possible to view the stopper of the container R through the orifice 5 of the head 3. This is aesthetically pleasing and/or prevents any interference with the radiation emitted by one or multiple electronic components which may be incorporated into the stopper Bo and/or this allows access to one or multiple security features incorporated into the stopper Bo.

In addition, when the user wants to open the container R, it is sufficient to pull on the strip 16 to cause the capsule 1 to be torn open and thus remove the capsule 1 from the container R. The user may then access the stopper Bo to open it.

Furthermore, the capsule 1 thus described may be easily stacked and may also be easily detached from a corresponding column of identical capsules. In particular, the shoulders 10, 11 stiffen the capsule 1, that makes it easier for them to be handled, and the second shoulder 11 prevents the capsules 1 from being pushed too far into each other. Indeed, when two capsules 1 are stacked, the free edge 17 of the first capsule 1 abuts against the second shoulder 11 of the second capsule 1, limiting how far the second capsule 1 may be pushed into the first capsule 1.

Consequently, it is possible to use the capsule 1 thus described with storage magazines of the prior art or packaging machines of the prior art.

Figure 4:
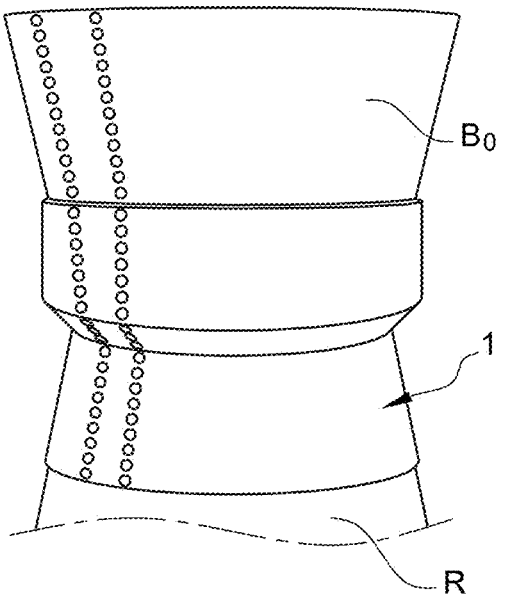
FIG. 4 is a perspective view of a part of a container sealed by a capsule according to a second embodiment of the invention.

With reference to FIG. 4, the following is a description of a second embodiment.

In reality, the capsule 1 described is identical to that of the first embodiment. It is the shape of the container R that is different with a stopper Bo that protrudes from the top of the container R, whereas it was level with the upper end of the neck in the first embodiment. The stopper Bo is also frustoconically-shaped, flaring towards the upper end of the neck, and no longer cylindrical as in the first embodiment.

Nevertheless, thanks to its heat-shrinkable plastic material and its good level of centring on the neck via the first shoulder 10, the capsule 1 yet makes it possible to match the shape of the top part of the container R. In particular, the capsule 1 encloses the container R so as to extend from an area of the neck of the container R to the stopper Bo of the container R. The skirt 4 then encloses the corresponding section of the neck at 360° and the head 3 partially covers an upper face of the stopper Bo.

Apart from what has been indicated in this case, everything that has been said for the first embodiment is also applicable for the second embodiment.

The invention is not limited to the embodiments described, and on the contrary, the invention covers any variant using equivalent means to reproduce the essential characteristics set out above.

The body may comprise a large number of sections other than that specified.

At least one of the sections other than the first section may have a constant cross-section along its length and/or the first section may have a cross-section that increases along its height and preferably that increases in the direction opposite the head.

Regardless of the shape of the body, preferably the thickness of said body remains constant on at least one of the sections and more preferably on all of the three sections and more preferably on the entire body.

It is not essential for the body to comprise any pre-weakened areas. The pre-weakened area may be different from that described and, for example, may extend along only part of the height of the body.

The pre-weakened strip may be reinforced by a reinforcing tape in order to jointly form what the person skilled in the art refers to a "tirecell".

The skirt may take another shape and, for example, be generally cylindrically-shaped and be open at both ends, i.e., frustoconically-shaped. At least one of the sections may be frustoconically-shaped and/or at least one of the sections may be cylindrically-shaped.

Although, in this case, the body is single-layered, the body may be multi-layered, with at least one of its layers being made of a plastic material as described in the case of the single-layered material.

At least one of the shoulders may be at right angles to thus form an angle equal to 90° with at least one of the two sections delimiting it and/or at least one of the shoulders may not be at right angles and thus form an angle strictly greater than or strictly less than 90° with at least one of the two sections delimiting it. In all cases, care must preferably be taken to ensure that the shoulder extends in a plane that is normal to the axial direction of the capsule.

The capsule may comprise a grip tab extending or affixed at least in part to the strip delimited by the pre-weakened areas and/or the reinforcing tape arranged on said strip, so that the user may handle the strip. Preferably, the grip tab is also shaped to accommodate both shoulders of the body if it extends along the skirt. The grip tab may extend along the skirt and/or head.

Although, in this case, the body is closed, the body may not be closed. The capsule then comprises a flap that has a portion closing the body and a portion forming a grip tab extending from the body in a detached manner. As a result, pulling the flap opens the capsule, preferably in one single piece. The flap may extend along the skirt and/or head. Preferably, at least the portion of the flap closing the body is also shaped to both shoulders of the body if said portion extends along the skirt.

The capsule may comprise a safety strip arranged on the internal face of the body (i.e., the face intended to come into contact with the container that is to be covered). In this case, the safety strip may extend substantially along the entire circumference of the body. Said safety strip may be shaped so as to fit under the ring of a container. Patent EP 3 318 505 of the present applicant describes, for example, such a security strip.

The body may equally well be transparent or opaque. The body may be transparent in some areas and opaque in other areas. The body may have impressions on at least part of its surface and on one or both of its faces. Information for the user may thus be written on the body. The same paragraph applies for the flap and/or grip tab and/or safety strip mentioned above.

Preferably, when the capsule is a first capsule which is stacked on top on a second capsule according to the invention, and that a third capsule according to the invention is stacked on top on a third capsule, the first capsule is defined such that a slip coefficient (sometimes called the adhesion coefficient) of the internal surface of the body/external surface of the second capsule and/or the external surface of the body/internal surface of the third capsule is known and controlled. Preferably, the capsule is defined such that the slip coefficient of the internal surface of the body/external surface of the second capsule is less than that of the external surface of the body/internal surface of the third capsule.

By thus controlling the internal and/or external surface state of the body (and therefore of the capsule), it is even easier to remove a capsule from a capsule column. In particular, this makes it easier to move between two capsules which are fitted into each other.

For example, the internal surface of the body is defined so as to have a slip coefficient internal surface of the body/external surface of the second capsule of between 0.05 and 0.4 and, for example, between 0.17 and 0.3 and/or the external surface of the body is defined so as to have a slip coefficient external surface of the body/internal surface of the third capsule greater than that of the internal surface and, for example, a slip coefficient greater than 0.3 and, for example, a slip coefficient greater than 0.45. For example, the slip coefficient of the external surface of the body/internal surface of the third capsule is between 0.3 and 0.45, however, remaining greater than that of the internal surface of the body/external surface of the second capsule.

This control of the internal and/or external surface conditions of the body may be achieved by various means, for example:

- by adding at least one layer of a coating covering at least one area of the internal and/or external surface of the body; and/or
- by adding at least one additive to the composition of the body; and/or
- by controlling the composition of the body; etc.

For example, the body may be defined such that at least one of its internal or external surfaces permits to reach a target slip coefficient with the surface of the other capsule in contact, with an anti-slip coating (or, conversely, adhesion coating) then being applied to at least one area of the other of its internal or external surfaces to also permit to reach a target slip coefficient with a differential to that of one of the other internal or external surface. The capsule may thus comprise at least one layer of a coating covering at least one area of the body. The layer of the coating may, for example, be a layer of an anti-slip coating or a layer of an adhesion coating. The layer of the coating may be applied to at least one portion of the internal face of the body and/or the external face of the body. The layer of the coating may be applied continuously over an entire area of the body or discontinuously, for example, by means of stippling. If the capsule comprises at least two layers of the coating, said layers may be juxtaposed and/or superposed.

The container to which the capsule is affixed may be of any type: glass, plastic, etc. The body may, for example, be based on, or made of, a material that is at least in part bio-sourced. For example, the material may be formed at least in part by a bio-sourced plastic such as PLA, a PLA derivative or any other bio-sourced plastic. For the purposes of the present application, it must be noted that a "bio-sourced" product is manufactured with material derived from living organisms, and more precisely, plant-based materials (wood, hemp, beetroot, maize, etc.) or animal-based materials (wool, organic waste, etc.). The tape may be compostable depending on the material used.

Although, in this case, the head partially covers only the stopper of the container that the capsule encloses, the head may completely cover the stopper of the container that the capsule encloses.

When the head partially covers the stopper of the container, the capsule may comprise a seal engaging with the body to be able to completely close the head so that the stopper of the container is completely sealed by the capsule. For example, the seal may be a washer arranged on the external face and/or the internal face of the body and, for example, of the head. The seal may, for example, be bonded to the body, for example, by a heat-activated adhesive.

The invention claimed is:

1. A capsule comprising a body made of heat-shrinkable plastic material, the body comprising:

a head; and a skirt extending from the head along an axial direction, the skirt comprising at least three sections extending successively along the axial direction, the first section and the second section jointly forming a first shoulder of the skirt, the second section and the third section jointly forming a second shoulder of the skirt, the skirt being shaped such that its diameter increases in its second section, relative to the first section, and then narrows in its third section, relative to the second section.

2. The capsule according to claim 1, wherein the first section is contiguous with the head, the second section being arranged under the first section and the third section being arranged under the second section.

3. The capsule according to claim 1, wherein at least one of the sections is cylindrically-shaped.

4. The capsule according to claim 1, wherein at least one of the shoulders has a flat portion.

5. The capsule according to claim 4, wherein the flat portion extends in a plane that is normal to the axial direction.

6. The capsule according to claim 1, wherein the head is perforated with an orifice centred on the head.

7. The capsule according to claim 1, wherein the body is made of or based on PET.

8. The capsule according to claim 1, wherein an internal surface of the body and an external surface of the body have different slip coefficients.

9. The capsule according to claim 1, wherein at least one of the second or third sections is externally in the shape of a truncated cone.

10. The container covered by the capsule according to claim 1.

* * * * *